US010197004B2

(12) United States Patent
Pursifull et al.

(10) Patent No.: US 10,197,004 B2
(45) Date of Patent: Feb. 5, 2019

(54) METHOD FOR CONTROLLING A DUAL LIFT PUMP FUEL SYSTEM

(71) Applicant: Ford Global Technologies, LLC, Dearborn, MI (US)

(72) Inventors: Ross Dykstra Pursifull, Dearborn, MI (US); Joseph Lyle Thomas, Kimball, MI (US); David Gimby, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 65 days.

(21) Appl. No.: 15/168,476

(22) Filed: May 31, 2016

(65) Prior Publication Data

US 2017/0342936 A1 Nov. 30, 2017

(51) Int. Cl.

| | |
|---|---|
| ***F02D 41/00*** | (2006.01) |
| ***F02D 41/38*** | (2006.01) |
| ***F02D 41/10*** | (2006.01) |
| ***F02M 59/44*** | (2006.01) |
| *F02D 41/26* | (2006.01) |
| *F02D 41/30* | (2006.01) |

(52) U.S. Cl.

CPC ..... *F02D 41/3845* (2013.01); *F02D 41/10* (2013.01); *F02D 41/3854* (2013.01); *F02M 59/44* (2013.01); *F02D 41/266* (2013.01); *F02D 41/3082* (2013.01); *F02D 2200/0602* (2013.01)

(58) Field of Classification Search

CPC ..... F02D 41/3845; F02D 41/10; F02M 59/44
USPC ..... 123/446, 447, 496, 326, 370, 436, 675, 123/682, 485, 492, 508; 701/101, 103, 701/104; 73/114.42; 74/838
See application file for complete search history.

(56) References Cited

U.S. PATENT DOCUMENTS

| | | | | |
|---|---|---|---|---|
| 5,505,180 | A * | 4/1996 | Otterman | F02D 41/2464 123/497 |
| 6,125,823 | A * | 10/2000 | Thomas | F02D 41/1497 123/299 |
| 7,234,451 | B2 * | 6/2007 | Betz, II | B60K 15/077 123/509 |
| 8,061,329 | B2 | 11/2011 | Pursifull et al. | |
| 8,302,582 | B2 * | 11/2012 | Oohashi | F02M 37/0029 123/446 |
| 8,776,764 | B2 * | 7/2014 | Basmaji | F02D 19/0605 123/27 GE |
| 2003/0233997 | A1 * | 12/2003 | Kawaguchi | F02D 41/0085 123/299 |
| 2005/0155582 | A1 * | 7/2005 | Schelhas | F02D 33/006 123/497 |

(Continued)

OTHER PUBLICATIONS

Pursifull, Ross Dykstra, et al., "Method for Operating a Dual Lift Pump System," U.S. Appl. No. 4/831,561, filed Aug. 20, 2015, 78 pages.

*Primary Examiner* — Thomas Moulis
*Assistant Examiner* — John Bailey
(74) *Attorney, Agent, or Firm* — Julia Voutyras; McCoy Russell LLP

(57) ABSTRACT

Methods and systems are provided for operating a fuel system comprising two lift pumps. In one example, a method may comprise adjusting operation of a first lift pump to achieve a desired fuel rail pressure. The method may comprise powering on a second lift pump to achieve the desired fuel rail pressure when operating only the first lift pump is not sufficient to achieve the desired fuel rail pressure.

18 Claims, 6 Drawing Sheets

(56) References Cited

U.S. PATENT DOCUMENTS

| | | | | |
|---|---|---|---|---|
| 2005/0241617 | A1* | 11/2005 | Kojima | F02D 41/3094 123/446 |
| 2005/0274362 | A1* | 12/2005 | DeRaad | F02D 41/062 123/497 |
| 2009/0187327 | A1* | 7/2009 | Grant | F02D 41/3082 701/103 |
| 2010/0024770 | A1* | 2/2010 | Pursifull | F02M 37/0064 123/446 |
| 2012/0145126 | A1* | 6/2012 | Krug | F02D 19/0628 123/447 |
| 2013/0074486 | A1* | 3/2013 | McWethy | E02F 3/964 60/428 |
| 2014/0014073 | A1 | 1/2014 | Scholz et al. | |
| 2014/0069385 | A1* | 3/2014 | Surnilla | F02D 19/022 123/446 |
| 2014/0224209 | A1* | 8/2014 | Pursifull | F02M 63/0001 123/294 |
| 2014/0230794 | A1 | 8/2014 | Sumilla et al. | |
| 2015/0275816 | A1* | 10/2015 | Pursifull | F02D 41/3094 123/456 |
| 2016/0025030 | A1 | 1/2016 | Ulrey et al. | |
| 2016/0146146 | A1 | 5/2016 | Pursifull | |
| 2016/0153385 | A1 | 6/2016 | Pursifull | |
| 2016/0186682 | A1* | 6/2016 | Surnilla | F02D 41/3082 123/446 |
| 2017/0051701 | A1* | 2/2017 | Pursifull | F02M 37/10 |

* cited by examiner

METHOD FOR CONTROLLING A DUAL LIFT PUMP FUEL SYSTEM

FIELD

The present description relates generally to methods and systems for regulating fuel pump operation.

BACKGROUND/SUMMARY

Vehicle engine systems such as those providing higher torque may utilize gasoline direct injection (GDI) to increase power delivery and engine performance. GDI fuel injectors in these vehicle engine systems demand fuel at higher pressure for direct injection to create enhanced atomization providing more efficient combustion. In one example, a GDI system can utilize an electrically driven lower pressure pump (also termed a lift pump) and a mechanically driven higher pressure pump (also termed a direct injection fuel pump) arranged respectively in series between the fuel tank and the fuel injectors along a fuel passage. In many GDI applications the lift fuel pump initially pressurizes fuel from the fuel tank to a fuel passage coupling the lift pump and direct injection fuel pump, and the high-pressure or direct injection fuel pump may be used to further increase the pressure of fuel delivered to the fuel injectors.

In a single lift pump system, a lift pump is operated to pump fuel to port injectors or a direct injection fuel pump. Lift pumps may have large dynamic ranges to be capable of pumping fuel at a low pump rate, as at idling conditions, or at a high pump rate, as during high engine load conditions. Additionally, lift pump pumping efficiency is dependent upon the flow rate of the pump, where lower fuel flow rates correspond to lower pumping efficiencies. Often, an engine is operated at low fuel flow rate conditions, and so, a large capacity fuel pump may operate at low pumping efficiency during this time, wasting electrical energy. Alternatively, if a small capacity fuel pump is included in the engine fueling system instead of a larger capacity fuel pump, the smaller fuel pump may be unable to supply enough fuel during high engine load conditions, resulting in an engine torque output being below a desired engine torque. Some approaches aimed at reducing pump losses and increasing fuel delivery may include two fuel lift pumps.

However, the inventors herein have recognized potential issues with such systems. As one example, the two lift pumps may not be independently controlled, and even if they are, they may both operate during a majority of vehicle operation. When the lift pumps are both operated such that their flow rates are low, an imbalance may occur between the lift pumps where, the flow rate from one pump may become significantly reduced relative to the other pump. Thus, in some examples, although power may be supplied to both pumps, only one of the pumps may be pumping fuel. Thus, energy and fuel may be wasted providing power to the pump that is not pumping fuel or is pumping fuel at a reduced rate relative to the other pump.

In one example, the issues described above may be addressed by a method comprising, adjusting operation of a first lift pump based on a difference between a desired fuel rail pressure and a measured fuel rail pressure, and in response to one or more of an accelerator pedal tip-in, desired fuel rail pressure increasing above a threshold pressure, and the difference between the desired fuel rail pressure and the measured fuel rail pressure increasing by more than a threshold difference, powering on a second lift pump. In this way, fuel consumption may be reduced by only powering on the second lift pump when additional fuel pressure is needed, and when a desired fuel flow rate from the lift pumps is high.

In another representation, a method may comprise: generating a fuel pump command based on one or more of a desired fuel pressure, a difference between the desired fuel pressure and a measured fuel pressure, and a fuel injection amount, determining a first duty cycle for a first lift pump based on the fuel pump command, determining a second duty cycle for a second lift pump based on the fuel pump command, and adjusting operation of the first and second lift pumps based on the first and second duty cycles, respectively.

In another representation, a fuel system may comprise: a first lift pump, a second lift pump, a first lift pump module for regulating a first duty cycle of the first lift pump, a second lift pump module for regulating a second duty cycle of the second lift pump, and a controller in electrical communication with the first and second pump modules, where the controller may include computer-readable instruction stored in non-transitory memory for: generating a lift pump command signal based on a difference between a desired fuel rail pressure and a measured fuel rail pressure, and transmitting the lift pump command signal to the first lift pump module and second lift pump module.

In this way, fuel rail pressure may be more closely be matched to a desired fuel rail pressure by operating two lift pumps differently based on common input command from an engine controller. Further, a technical effect of reducing fuel consumption is achieved by operating a smaller lift pump when the difference between a desired fuel rail pressure and a measured fuel rail pressure is less than a threshold. Thus, by only operating both a first lift pump and second lift pump when the difference between the desired fuel rail pressure and the measured fuel rail pressure is greater than a threshold difference, energy consumption may be reduced, and the longevity of a lift pump may be increased. Further, an amount of electrical wiring and processing hardware may be reduced by differentially operating two lift pump given the same input command from an engine controller.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
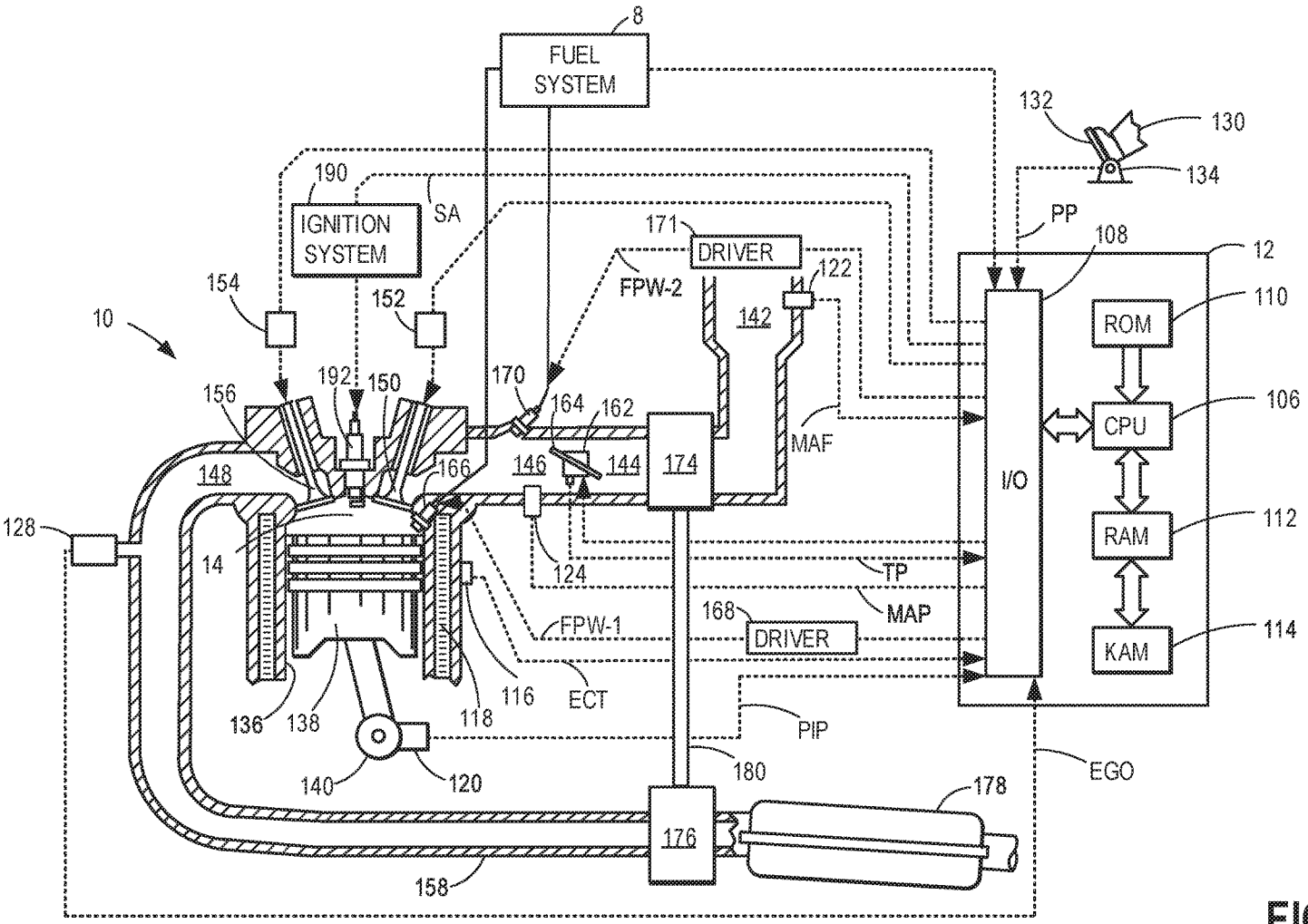
FIG. 1 shows a schematic diagram of an example engine system including a fuel system, in accordance with an embodiment of the present disclosure.

The following description relates to systems and methods for operating a fuel system of an engine system, such as the example engine system shown in FIG. 1. The fuel system may include two lift pumps, such as in the example fuel system shown in FIG. 2. A controller may control operation of the lift pumps via pump control modules, as is shown in the example fuel pump control system in FIG. 3. In particular, the controller may feedback control operation of the two lift pumps via respective pump control modules. Thus, the controller may send command signals to the control modules for operating the lift pumps, and the control modules may in turn regulate an amount of electrical power supplied to the respective lift pumps based on the command signals received from the controller. Thus, the controller may send command signals to the control modules for operating the lift pumps, and the control modules may in turn regulate an amount of electrical power supplied to the respective lift pumps based on the command signals received from the controller. In some examples, as described in the example control routine of FIG. 4, the two lift pumps may be operated differently. In particular, the controller may send a single command signal to both of the control modules, but the two control modules may be configured to interpret the command signal differently. As such, when given the same input, the outputs generated by the control modules in response to the same input may be different. By operating two differently sized fuel pumps via a single command signal from a controller, the cost and complexity of the fuel system may be reduced.

Figure 5:
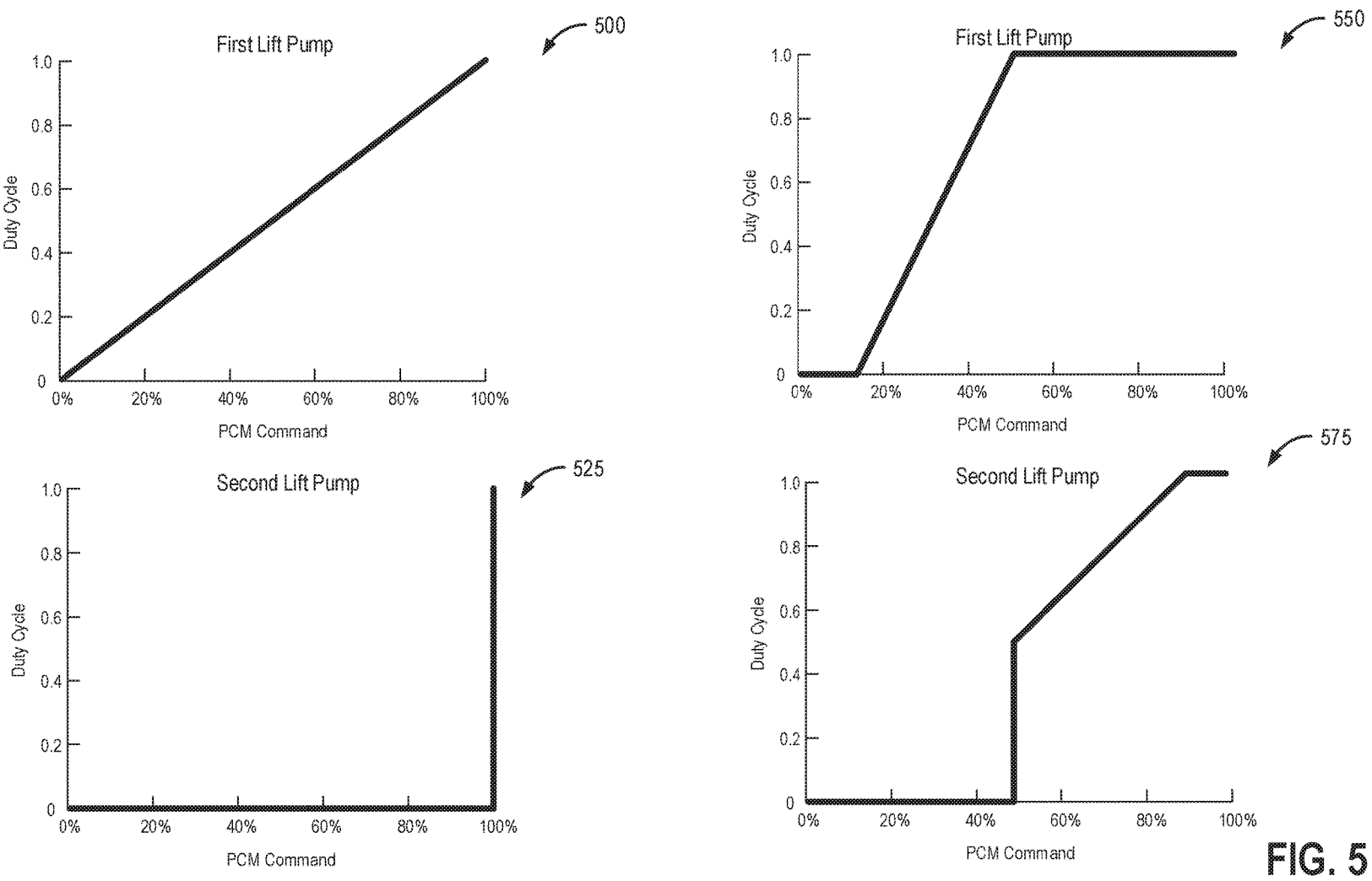
FIG. 5 shows graphs depicting example changes in pump command voltage and duty cycle for two lift pumps of a fuel system, such as the fuel system of FIG. 1, in accordance with an embodiment of the present disclosure.

A first smaller fuel pump may be operated continuously, varying with the command signal, and a second larger fuel pump may be operated when the fuel demand greater than a threshold, such as according to the pumping duty cycle illustrated in FIG. 5. A desired fuel rail pressure may more accurately may be maintained by independently controlling the two differently sized fuel pumps. Further, power and thus fuel consumption of the fuel system may be reduced by operating the two pumps differently. An example fuel pump command and control operation is shown with reference to FIG. 6. In this way, fuel may be pumped efficiently over a dynamic range of fuel flow rates to supply fuel at a desired fuel flow rate.

Regarding terminology used throughout this detailed description, a high pressure pump, or direct injection fuel pump, may be abbreviated as a HP pump (alternatively, HPP) or a DI fuel pump respectively. Accordingly, HPP and DI fuel pump may be used interchangeably to refer to the high pressure direct injection fuel pump. Similarly, a low pressure pump, may also be referred to as a lift pump. Further, the low pressure pump may be abbreviated as LP pump or LPP. Port fuel injection may be abbreviated as PFI while direct injection may be abbreviated as DI. Also, fuel rail pressure, or the value of pressure of fuel within the fuel rail (most often the direct injection fuel rail), may be abbreviated as FRP. The direct injection fuel rail may also be referred to as a high pressure fuel rail, which may be abbreviated as HP fuel rail. Also, the solenoid activated inlet check valve for controlling fuel flow into the HP pump may be referred to as a spill valve, a solenoid activated check valve (SACV), electronically controlled solenoid activated inlet check valve, and also as an electronically controlled valve. Further, when the solenoid activated inlet check valve is activated, the HP pump is referred to as operating in a variable pressure mode. Further, the solenoid activated check valve may be maintained in its activated state throughout the operation of the HP pump in variable pressure mode. If the solenoid activated check valve is deactivated and the HP pump relies on mechanical pressure regulation without any commands to the electronically-controlled spill valve, the HP pump is referred to as operating in a mechanical mode or in a default pressure mode. Further, the solenoid activated check valve may be maintained in its deactivated state throughout the operation of the HP pump in default pressure mode.

FIG. 1 depicts an example of a combustion chamber or cylinder of internal combustion engine 10. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder 14 (herein also termed combustion chamber 14) of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system (not shown). Further, a starter motor (not shown) may be coupled to crankshaft 140 via a flywheel (not shown) to enable a starting operation of engine 10.

Cylinder 14 can receive intake air via a series of intake air passages 142, 144, and 146. Intake air passages 142, 144, and 146 can communicate with other cylinders of engine 10 in addition to cylinder 14. In some examples, one or more of the intake passages may include a boosting device such as a turbocharger or a supercharger. For example, FIG. 1 shows engine 10 configured with a turbocharger including a compressor 174 arranged between intake air passages 142 and 144, and an exhaust turbine 176 arranged along exhaust passage 158. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 162 including a throttle plate 164 may be provided along an intake passage of the engine for varying the flow rate and/or pressure of intake air provided to the engine cylinders. For example, throttle 162 may be positioned downstream of compressor 174 as shown in FIG. 1, or alternatively may be provided upstream of compressor 174.

Exhaust manifold 148 can receive exhaust gases from other cylinders of engine 10 in addition to cylinder 14. Exhaust gas sensor 128 is shown coupled to exhaust passage 158 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other examples, the intake and exhaust valves may be controlled by a common valve actuator or actuation system, or a variable valve timing actuator or actuation system.

Cylinder 14 can have a compression ratio, which is the ratio of volumes when piston 138 is at bottom center to top center. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some examples, each cylinder of engine 10 may be configured with one or more fuel injectors for providing fuel thereto. As a non-limiting example, cylinder 14 is shown including two fuel injectors 166 and 170. Fuel injectors 166 and 170 may be configured to deliver fuel received from fuel system 8. As elaborated in FIG. 2, fuel system 8 may include one or more fuel tanks, fuel pumps, and fuel rails. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 1 shows injector 166 positioned to one side of cylinder 14, it may alternatively be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a fuel tank of fuel system 8 via a high pressure fuel pump, and a fuel rail. Further, the fuel tank may have a pressure transducer providing a signal to controller 12.

Fuel injector 170 is shown arranged in intake air passage 146, rather than in cylinder 14, in a configuration that provides what is known as port injection of fuel (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single electronic driver 168 or 171 may be used for both fuel injection systems, or multiple drivers, for example electronic driver 168 for fuel injector 166 and electronic driver 171 for fuel injector 170, may be used, as depicted.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector. As such, it should be appreciated that the fuel systems described herein should not be limited by the particular fuel injector configurations described herein by way of example.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold.

Figure 2:
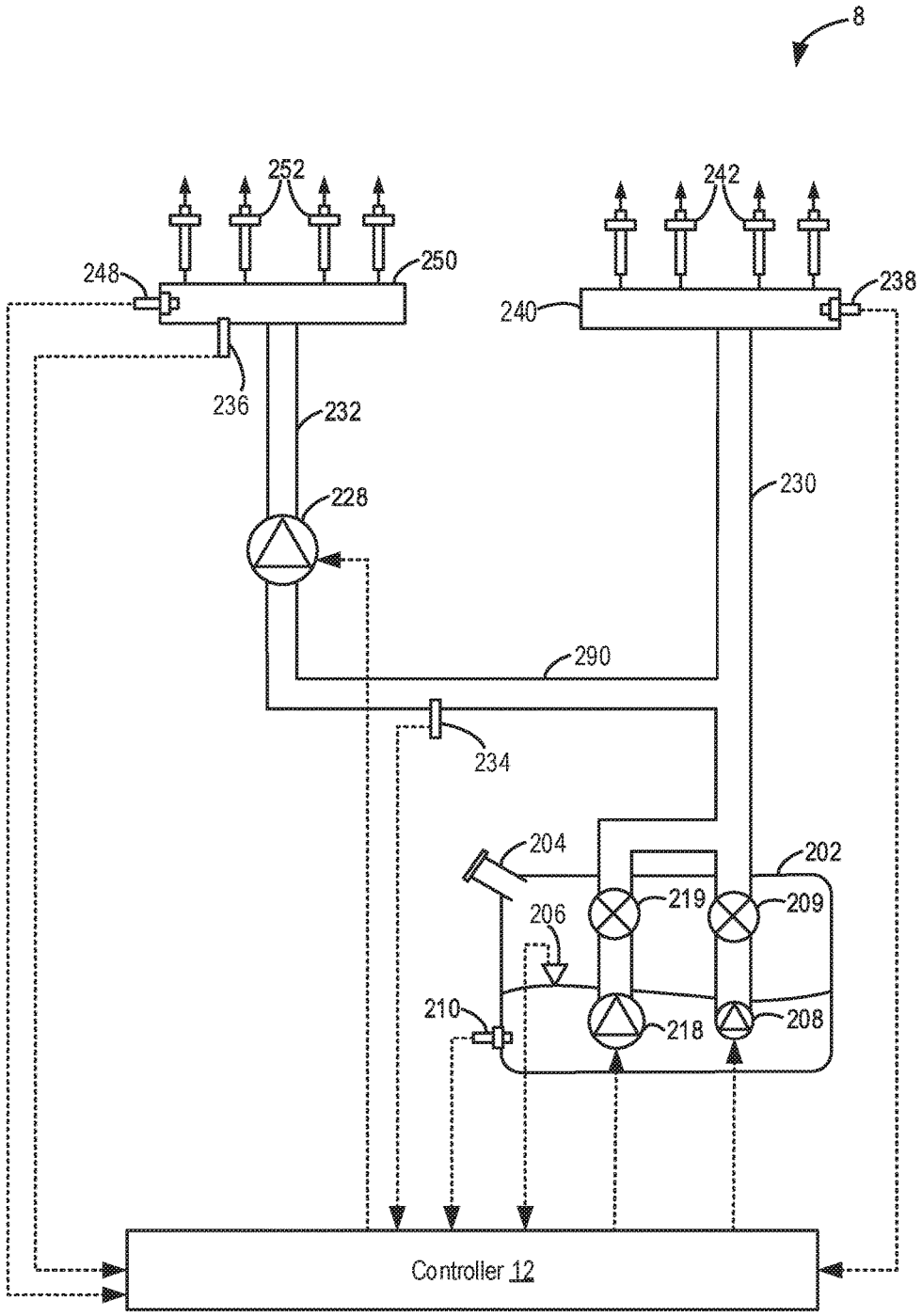
FIG. 2 shows an example embodiment of the fuel system of FIG. 1 including two lift pumps, in accordance with an embodiment of the present disclosure.

FIG. 2 schematically depicts an example fuel system 8 of FIG. 1. Fuel system 8 may be operated to deliver fuel from a fuel tank 202 to direct fuel injectors 252 and port injectors 242 of an engine, such as engine 10 of FIG. 1. Fuel system 8 may be operated by a controller, such as controller 12 of FIG. 1, to perform some or all of the operations described below with reference to the example routine in FIG. 4.

Fuel system 8 can provide fuel to an engine, such as example engine 10 of FIG. 1, from a fuel tank 202. By way of example, the fuel may include one or more hydrocarbon components, and may also include an alcohol component. Under some conditions, this alcohol component can provide knock suppression to the engine when delivered in a suitable amount, and may include any suitable alcohol such as ethanol, methanol, etc. As another example, the alcohol (e.g. methanol, ethanol) may have water added to it. As a specific non-limiting example, fuel may include gasoline and ethanol, (e.g., E10, and/or E85). Fuel may be provided to fuel tank 202 via fuel filling passage 204.

A first low pressure fuel pump 208 (herein, also termed first lift pump 208) and second low pressure fuel pump 218 (herein, also termed second lift pump 218) in communication with fuel tank 202, may be powered to supply fuel to one or more of a first fuel rail 240 and/or second fuel rail 250. In particular, the pumps 208 and 218 may be operated to supply fuel from fuel tank 202 to a first group of port injectors 242, via a first fuel passage 230. Lift pumps 208 and 218 may also be referred to as LPPs 208 and 218, or LPs (low pressure) pumps 208 and 218. In one example, LPPs 208 and 218 may be electrically-powered lower pressure fuel pumps disposed at least partially within fuel tank 202. Fuel lifted by LPPs 208 and 218 may be supplied at a lower pressure into a first fuel rail 240 coupled to one or more fuel injectors of first group of port injectors 242 (herein also referred to as first injector group). A first LPP check valve 209 may be positioned at an outlet of the LPP 208. LPP check valve 209 may direct fuel flow from LPP 208 to first fuel passage 230 and second fuel passage 290, and may block fuel flow from first and second fuel passages 230 and 290 respectively back to LPP 208. Similarly, a second LPP check valve 219 may be positioned at an outlet of the LPP 218. LPP check valve 219 may direct fuel flow from LPP 218 to first fuel passage 230 and second fuel passage 290, and may block fuel flow from first and second fuel passages 230 and 290 respectively back to LPP 218.

While first fuel rail 240 is shown dispensing fuel to four fuel injectors of first group of port injectors 242, it will be appreciated that first fuel rail 240 may dispense fuel to any suitable number of fuel injectors. As one example, first fuel rail 240 may dispense fuel to one fuel injector of first group of port injectors 242 for each cylinder of the engine. Note that in other examples, first fuel passage 230 may provide fuel to the fuel injectors of first group of port injectors 242 via two or more fuel rails. For example, where the engine cylinders are configured in a V-type configuration, two fuel rails may be used to distribute fuel from the first fuel passage to each of the fuel injectors of the first injector group.

Direct injection fuel pump 228 (or DI pump 228 or high pressure pump 228) is included in second fuel passage 232 and may receive fuel via LPP 208. In one example, direct injection fuel pump 228 may be a mechanically-powered positive-displacement pump. Direct injection fuel pump 228 may be in communication with a group of direct fuel injectors 252 via a second fuel rail 250. Second fuel rail 250 may be a high (or higher) pressure fuel rail. Direct injection fuel pump 228 may further be in fluidic communication with first fuel passage 230 via second fuel passage 290. Thus, fuel at lower pressure lifted by LPP 208 may be further pressurized by direct injection fuel pump 228 so as to supply higher pressure fuel for direct injection to second fuel rail 250 coupled to one or more direct fuel injectors 252 (herein also referred to as second injector group). In some examples, a fuel filter (not shown) may be disposed upstream of direct injection fuel pump 228 to remove particulates from the fuel.

The various components of fuel system 8 communicate with an engine control system, such as controller 12. For example, controller 12 may receive an indication of operating conditions from various sensors associated with fuel system 8 in addition to the sensors previously described with reference to FIG. 1. The various inputs may include, for example, an indication of an amount of fuel stored in fuel tank 202 via fuel level sensor 206. Controller 12 may also receive an indication of fuel composition from one or more fuel composition sensors, in addition to, or as an alternative to, an indication of a fuel composition that is inferred from an exhaust gas sensor (such as sensor 128 of FIG. 1). For example, an indication of fuel composition of fuel stored in fuel tank 202 may be provided by fuel composition sensor 210. Fuel composition sensor 210 may further comprise a fuel temperature sensor. Additionally or alternatively, one or more fuel composition sensors may be provided at any suitable location along the fuel passages between the fuel storage tank and the two fuel injector groups.

Fuel system 8 may further include one or more pressure sensors for sensing a fuel pressure at various points in the fuel system 8. For example, a first pressure sensor 238 be coupled to a first fuel rail 240, and a second pressure sensor 248 may be coupled to a second fuel rail 250. Pressure sensor 238 may be used to determine a fuel line pressure of second fuel passage 290 and/or first fuel rail 240. Thus, in some examples, the pressure sensed by the first pressure sensor 238 may correspond to a delivery pressure of low pressure pump 208. Second pressure sensor 248 may be positioned downstream of DI fuel pump 228 in second fuel rail 250 and may be used to measure fuel rail pressure (FRP)

in second fuel rail 250. Sensed pressures at different locations in fuel system 8 may be communicated to controller 12.

LPPs 208 and 218 may be used for supplying fuel to one or more of the first fuel rail 240 during port fuel injection and the DI fuel pump 228 during direct injection of fuel. During both port fuel injection and direct injection of fuel, LPPs 208 and 218 may be controlled by controller 12 to supply fuel to the first fuel rail 240 and/or the DI fuel pump 228 based on fuel rail pressure in each of first fuel rail 240 and second fuel rail 250.

Controller 12 may operate LPP 208 substantially continuously during engine operation to maintain fuel pressure in the fuel rails 240 and 250, and fuel passages 290 and 230 above the fuel vapor pressure. However, in other examples, the LPP 208 may periodically be powered OFF, for example when the measured fuel rail pressure is greater than desired and/or the fuel rail pressure is greater than the fuel vapor pressure. Further, controller 12 may not operate LPP 218 continuously. For example, LPP 218 may be powered on when a desired fuel rail pressure increases above a threshold and/or a difference between the desired fuel rail pressure and the measured fuel rail pressure obtained from one or more of the pressure sensor 238 and 248 is greater than a threshold. In yet further examples, the LPP 218 may only be powered on when a desired fuel flow rate to one or more of the fuel rails 240 and 250 is greater than a threshold. The desired fuel flow rate may be a flow rate sufficient to maintain a desired fuel rail pressure and/or fuel injection amount. Thus, LPP 218 may only be powered on when the LPP 208 is not providing sufficient fuel pressure, and additional fuel pressure is needed to achieve the desired fuel rail pressure. In particular, power to the LPP 208 may be adjusted to achieve the desired fuel rail pressure. When maximum power is supplied to the LPP 208, and the desired fuel rail pressure is not achieved and/or the desired fuel flow rate to the fuel rail is not achieved, then LPP 218 may be powered on to provide additional fuel pressure to match the desired fuel rail pressure. For example, when the fuel injection flow rate is greater than a threshold, LPP 208 may not be sufficient to supply an amount of fuel to one or more the fuel rails 240 and/or 250 lost during injection via the injectors 242 and/or 252. As such, LPP 218 may be powered on when one or more of a desired fuel injection amount exceeds a threshold, the desired fuel flow rate to the one or more fuel rails 240 and/or 250 exceeds a threshold, the desired fuel pressure exceeds a threshold, etc. The desired fuel injection amount may be determined based on a driver demanded torque which may be determined based on a position of the input device 132, an intake mass airflow rate, a desired air/fuel ratio, a position of the intake throttle 162, etc. Thus, the desired fuel injection amount may be an amount of fuel sufficient to achieve the desired air/fuel ratio and deliver the driver demanded torque.

The LPP 208 and/or LPP 218 may be turbine pumps which may be powered by respective variable speed motors. In some examples, LPP 208 may be a smaller pump than LPP 218. Thus, the LPP 208 may be referred to herein as smaller first LPP 208, and LPP 218 may be referred to herein as larger second LPP 218. That is, the size of an impeller of the LPP 218 may be larger than that of LPP 208, and/or the motor of LPP 218 may be more powerful than the motor of LPP 208. Thus, a maximum electrical power (e.g., maximum voltage and/or maximum current) that may be supplied to the LPP 218 may be greater than that of the LPP 208. Thus, the LPP 218 may pump a higher volumetric flow rate of fuel than the LPP 218, when the pumps 208 and 218 are operated at their respective maximum voltages. Said another way, a maximum fuel flow rate of LPP 218 may be greater than that of LPP 208.

The controller 12 may communicate with pump electronic modules (PEMs) for each of the pumps 208 and 218. Based on the signals received from the controller 12, the PEMs may adjust an amount of electrical power supplied to the electric motors of the pumps 208 and 218. Thus, each of the pumps 208 and 218 may include an electric motor coupled thereto for powering the pumps 208 and 218. The controller 12 may send a command to the PEMs corresponding to a desired electrical power to be supplied to the LPPs 208 and 218. In this description herein the command signal sent from the controller 12 to the PEMs may be referred to as the "PCM command." The PCM command may be generated based on one or more of the desired fuel rail pressure, a difference between the desired fuel rail pressure and the measured fuel rail pressure (feedback control), and a fuel injection amount (feedforward control). Thus, the PCM command may increase for greater differences between the desired fuel rail pressure and the measured fuel rail pressure when the measured fuel rail pressure is less than the desired fuel rail pressure, increases in the desired fuel rail pressure, and increases in the fuel injection amount. The electrical power supplied to one or more of the LPPs 208 and/or 218 may increase for increases in the PCM command. Thus, based on the PCM command signal received from the controller 12, the pump electronic modules may adjust an amount of electrical power supplied to the respective motors of the pumps 208 and 218.

In particular, the PEMs may operate one or more of the LPPs 208 and 218 in a pulsed mode and/or in a continuous mode. In the pulsed pump mode, the LPPs 208 and 218 may be powered periodically such that the LPPs 208 and 218 oscillate back and forth between ON and OFF. Thus, the LPPs 208 and 218 may be spun on for a first duration, such as any duration between 0.2 to 0.5 seconds, and may then be powered off for a second duration before being turned back on again. In some examples, the second duration may be greater than the first duration, such that during the pulsed pump mode, the LPPs 208 and/or 218 are powered on for less time than they are powered off. While the LPPs 208 and/or 218 are off, pressure may be stored in a pressure accumulator which may be inherent in the fuel system construction.

In another example, in the pulsed mode, one or more of the LPP 208 and/or 218 may be activated (as in, turned ON) but may be set at zero voltage. As such, this setting for LPP 208 may effectively ensure lower energy consumption by LPPs 208 and/or 218 while providing a faster response time when LPPs 208 and/or 218 are actuated. When low pressure pump operation is desired, voltage supplied to LPPs 208 and/or 218 may be increased from zero voltage to enable LP pump operation. Thus, LPPs 208 and/or 218 may be pulsed from a zero voltage to a non-zero voltage. In one example, LPP 208 may be pulsed from zero voltage to full voltage. In another example, LPPs 208 and/or 218 may be pulsed for short intervals such as 50 to 250 milliseconds at a non-zero voltage. A distinct voltage may be used based on duration of the short intervals. For example, LPPs 208 and/or 218 may be pulsed at 8 V when the short interval is between 0 to 50 milliseconds. Alternatively, if the duration of the short interval is 50 to 100 milliseconds, LPPs 208 and/or 218 may be pulsed at 10 V. In another example, LPPs 208 and/or 218 may be pulsed at 12 V when the interval is between 100 and 250 milliseconds.

In the continuous mode, a duty-cycled voltage may be supplied to the pump motors of the LPPs 208 and/or 218. The duty cycle may be the fraction of one cycle of the signal for which the signal is at the higher voltage. Thus, the duty cycle may be varied between 0 and 100%, where the relative amount of time that the duty-cycled signal is at the higher voltage may increase proportionally from 0 to 100%. The frequency of the signal may refer to the number of cycles per unit of time. This duty cycle provided to the pump motors may in some examples have a 10 kHz frequency. However, in other example, the frequency of the duty cycle may be greater or less than 10 kHz. In yet further examples, the frequency of the duty cycle may be varied.

In some examples, one or more of LPPs 208 and/or 218 may be operated at a 100% duty cycle such that the voltage signal provided to the LPPs is continuously at the higher voltage. In another example, one or more of the LPPs 208 and/or 218 may be operated at a 0% duty cycle, where the one or more LPPs 208 and/or 218 may be powered OFF or continuously supplied the lower voltage (e.g., ground) of the duty cycled signal. An amount of electrical power provided to the LPPs 208 and 218 may increase for increases in their respective duty cycles. Thus, by varying the duty cycle, electrical power to the LPPs 208 and 218 may be adjusted.

LPPs 208 and 218, and the DI fuel pump 28 may be operated to maintain a desired fuel rail pressure in second fuel rail 250. Pressure sensor 236 coupled to the second fuel rail 250 may be configured to provide an estimate of the fuel pressure available at the group of direct injectors 252. Then, based on a difference between the estimated rail pressure and a desired rail pressure, each of the pump outputs may be adjusted. In one example, where the DI fuel pump 228 is operating in a variable pressure mode, the controller 12 may adjust a flow control valve (e.g., solenoid activated check valve) of the DI fuel pump 228 to vary the effective pump volume (e.g., pump duty cycle) of each pump stroke. Further, LPP 208 may largely be activated with zero voltage and may be pulsed at a non-zero voltage only when fuel vapor is detected at an inlet of the DI fuel pump 228.

In another example, LPPs 208 and/or 218 may be operated in pulsed mode to maintain a fuel rail pressure (FRP) in the second fuel rail 250 when DI fuel pump 228 is operated in default pressure mode. Herein, LPPs 208 and/or 218 may be pulsed at full voltage when one or more pressure readings sensed by pressure sensor 236 during the compression stroke of DI fuel pump 228 are lower than a threshold pressure. As such, a plurality of pressure readings sensed only during compression strokes in the DI fuel pump 228 may be utilized. Further, in one example, an average of the plurality of readings may be obtained and if the average is below the threshold pressure, LPPs 208 and/or 218 may be pulsed with a non-zero voltage.

Controller 12 can also control the operation of each of fuel pumps LPPs 208 and 218, and DI fuel pump 228 to adjust an amount, pressure, flow rate, etc., of a fuel delivered to the engine. As one example, controller 12 can vary a pressure setting, a pump stroke amount, a pump duty cycle command, and/or fuel flow rate of the fuel pumps to deliver fuel to different locations of the fuel system. As one example, a DI fuel pump duty cycle may refer to a fractional amount of a full DI fuel pump volume to be pumped. Thus, a 10% DI fuel pump duty cycle may represent energizing a solenoid activated check valve such that 10% of the DI fuel pump volume may be pumped. A driver (not shown) electronically coupled to controller 12 may be used to send a control signal to LPPs 208 and/or 218, as required, to adjust the output (e.g. speed, delivery pressure) of the LPPs 208 and/or 218. The amount of fuel that is delivered to the group of direct injectors via the DI fuel pump 228 may be adjusted by adjusting and coordinating the output of the LPPs 208 and/or 218 and the DI fuel pump 228. For example, controller 12 may control the LPPs 208 and/or 218 through a feedback control scheme by measuring the low pressure pump delivery pressure in second fuel passage 290 (e.g., with pressure sensor 234) and controlling the output of the LPPs 208 and/or 218 in accordance with achieving a desired (e.g. set point) low pressure pump delivery pressure.

Figure 3:
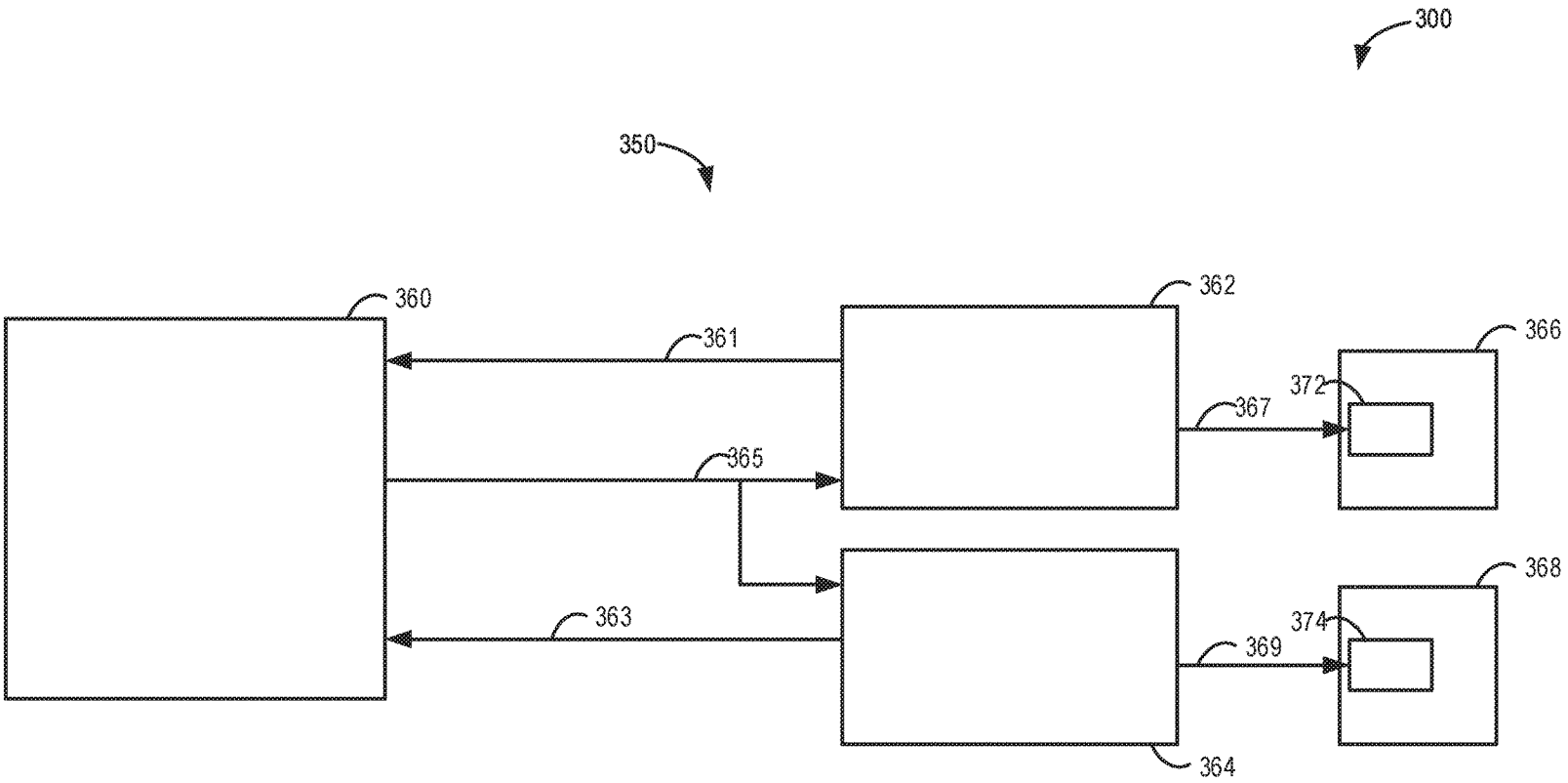
FIG. 3 shows a schematic diagram of the electrical connections and components of a control system for a fuel system, such as the fuel system of FIG. 1, in accordance with an embodiment of the present disclosure.

FIG. 3 illustrates a schematic 300 of an example fuel control system 350 for controlling two lift pumps that may be included in a fuel system, such as the fuel system 8 described above with reference to FIG. 1. In particular, the schematic 200 shows example components of the fuel control system 350, and the electrical connections between the components of the fuel control system 350. Thus, the schematic 200 shows how components of the fuel control system 350 may be electrically coupled to one another, and how the components may communicate with one another via electrical signals.

The fuel control system 350 may include a first lift pump 366 and a second lift pump 368 that may be controlled by a controller 360. The controller 360 may be a powertrain control module (PCM). As such, controller 360 may be the same or similar to controller 12 described above with reference to FIG. 1. In some examples, controller 360 may be controller 12. However, in other examples, the controller 360 may be a separate controller from the powertrain controller and may be a dedicated controller for the fuel system. First lift pump 366 may be the same or similar to lift pump 208 and/or second lift pump 368 may be the same or similar to lift pump 218 described above with reference to FIG. 1. In some examples, first lift pump 366 may be lift pump 208 and/or lift pump 368 may be lift pump 218.

As such, lift pump 366 may be smaller than lift pump 368. In one embodiment, lift pump 366 may be operated continuously while lift pump 368 may be operated intermittently as described in greater detail below with reference to the example method presented in FIG. 4. The fuel control system 350 may additionally include a first fuel pump electronics module 362 and a second fuel pump electronics module 364. The first fuel pump electronics module 362 may also be referred to herein as first PEM 362, and the second fuel pump electronics module may also be referred to herein as second PEM 364. The pump electronics modules 362 and 364 may receive commands from the controller 360 for regulating an amount of electrical power (e.g., voltage and/or current) supplied to the pumps 366 and 368. In particular, the module 362 may regulate an amount of electrical power supplied to the first lift pump 366, and module 364 may regulate an amount of electrical power supplied to the second lift pump 368. Thus, based on the electrical signals received from the controller 360, the modules 362 and 364 may adjust a voltage and/or current supplied to the pumps 366 and 368, respectively. In particular, the modules 362 and 364 may regulate an amount of electrical power supplied to respective electric motors of the pumps 366 and 368. Thus, module 362 may regulate an amount of electrical power supplied to a first motor 372 of the first lift pump 366, and the module 364 may regulate an amount of electrical power supplied to a second motor 374 of the second lift pump 368.

The controller 360 may comprise software (e.g., computer readable instructions stored in non-transitory memory) for determining a desired fuel pressure based on engine operating conditions estimated from various sensors, as described above with reference to FIG. 1. For example, the controller 360 may determine a desired fuel pressure based on one or more of a driver demanded torque as estimated based on the position of an accelerator pedal (e.g., input device 132 described above in FIG. 1), mass airflow rate, engine load, accessory loads, etc. The controller 360 may feedback control operation of the pumps 366 and 368 to achieve the desired fuel pressure in one or more fuel rails (e.g., fuel rails 240 and 250 described above in FIG. 2). Thus, the controller 360 may send signals to one or more of the modules 362 and/or 364 to adjust an amount of electrical power supplied to the pumps 366 and 368 based on a difference between the desired fuel pressure and a measured fuel pressure. The measured fuel rail pressure may be estimated via outputs from one or more fuel rail pressure sensors (e.g., fuel rail pressure sensors 238 and 248 described above in FIG. 2). Thus, the electrical power supplied to the motors 372 and 374 of the pumps 366 and/or 368, respectively, may be adjusted to more closely align the measured fuel rail pressure to the desired fuel rail pressure. As such, electrical power supplied to one or more of the pumps 366 and/or 368 may increase for increases in the difference between the measured fuel rail pressure and the desired fuel rail pressure when the measured fuel rail pressure is less than the desired fuel rail pressure. Further, the electrical power supplied to one or more of the pumps 366 and/or 368 may be adjusted based on a fuel injection amount. Thus, as the fuel injection amount increases, an amount of electrical power supplied to one or more of the pumps 366 and/or 368 may be increased to continue to supply fuel to the fuel rail, as fuel exits the fuel rail during fuel injection. In particular a desired fuel flow rate may be determined based on the fuel injection amount. The desired fuel flow rate may be a fuel flow rate from one or more the pumps 366 and/or 368 sufficient to maintain the fuel pressure in the fuel rail considering an amount of fuel leaving the fuel rail via the fuel injectors.

In particular, the controller 360 may generate and send a fuel pump command (FPC) signal 365, via a single output pin, to the pump electronics modules 362 and 364. As described above, the FPC signal 365 may be generated based on one or more of a desired fuel pressure, difference between the desired fuel pressure and measured fuel pressure, a driver demanded torque which may be estimated based on a position of an accelerator pedal (e.g., input device 132 described above in FIG. 1), and a desired fuel flow rate which may be determined based on a fuel injection amount. Thus, in some examples, the modules 362 and 364 may receive the same or similar signal from the controller 360. The command signal 365 sent from the controller 360 to the modules 362 and 364 may be encoded with a duty cycle and/or a frequency. In some examples, the duty cycle of the FPC signal 365 may have a frequency of approximately 250 Hz. However, in other examples, the frequency of the FPC signal 365 may be less than or greater than 250 Hz. In one example, the FPC signal 365 may be a duty cycled (DC) voltage indicating a command between 0V (or a low pump enabling voltage), representing a 0% command, and an upper limit voltage, representing a 100% command. In another example, the FPC may be a series of pulsed voltages to be interpreted as a percent command between a 0% and 100% command. The communicated demand may be encoded in the duty cycle or the pulsewidth of the signal 365, where the duty cycle may be independent of timer error in the sending device (e.g., controller 360).

Thus, the FPC signal 365 (e.g., voltage and/or duty cycle of the signal sent to the modules 362 and 364) may be adjusted to more closely align the measured fuel rail pressure to the desired fuel rail pressure. As such, the FPC signal 365 (e.g., voltage and/or duty cycle of the signal sent to the modules 362 and 364) may increase for increases in the difference between the measured fuel rail pressure and the desired fuel rail pressure when the measured fuel rail pressure is less than the desired fuel rail pressure. Further, the duty cycle of the FPC signal 365 may increase for increases in the desired fuel rail pressure, increases in the desired fuel flow rate, increases in the driver demanded torque, and increases in the fuel injection amount.

Because the same command signal may be used as an input by both modules 362 and 364, only one output pin on the controller or PCM 360 may be used to control lift pumps 366 and 368. Similarly, the FPC signal 365 may be communicated to the modules 362 and 364 via a single wire. However, in other examples it should be appreciated that the FPC signal 365 may be communicated to the modules 362 and 364 independently and that different wires may couple the modules 362 and 364 to the controller 360 for communicating the FPC signal 365. Further, in some examples the controller 360 may generate different FPC signals for the modules 362 and 364. Thus, the controller 360 may generate a first FPC signal for the module 362 and a second, different FPC signal for the module 364.

Based on the FPC signal 365 received from the controller 360, the pump electronics modules (PEMs) 362 and 364 may regulate an amount of electrical power supplied to the motors 372 and 374 of the pumps 366 and 368, respectively. Thus, the PEMs 362 and 364 may regulate an amount of electrical power (e.g., current and/or voltage) to be supplied to the motors 372 and 374 of the pumps 366 and 368, respectively. First PEM 362 may include computer readable instructions stored in non-transitory memory for decoding the FPC signal 365 received from controller 360 and determining an amount of electrical power to be supplied to motor 372 of pump 366 based on the FPC signal 365. Further, second PEM 364 may include computer readable instructions stored in non-transitory memory for decoding the FPC signal 365 received from controller 360 and determining an amount of electrical power to be supplied to motor 374 of pump 368 based on the FPC signal 365. In particular, the first PEM 362 may include a first look-up table relating FPC signal command to a duty cycle to be supplied to motor 372. Example look-up tables that may be stored in memory in PEM 362 are shown below in FIG. 5 at plots 500 and 550. The PEM 364 may include a second look-up table, different than the first look-up table of the first PEM 362, relating FPC signal command to a duty cycle to be supplied to motor 374. Example look-up tables that may be stored in memory in PEM 362 are shown below in FIG. 5 at plots 525 and 575. Thus, the PEMs 362 and 364 may include different computer readable instructions stored in non-transitory memory for interpreting the FPC signal 365 differently. In this way, PEM 362 may supply a different duty cycled voltage to motor 372 than PEM 364 may supply to motor 374 based on the same FPC signal command received from controller 360.

In some examples, the PEMs 362 and 364 may regulate an amount or intensity of the voltage and/or current supplied to the pumps 366 and 368, respectively. In particular, based on the FPC signal 365, module 362 may supply electrical power at a first duty cycle 367 to motor 372 of lift pump 366, and module 364 may supply electrical power at a second duty cycle 369 to motor 374 of lift pump 368. The duty cycles 367 and 369 transmitted from the modules 362 and 364, may be different voltages and/or currents. However, in other examples, the duty cycles 367 and 369 may be approximately the same voltages and/or currents. It should be appreciated that in some examples, the pumps 366 and 368 may not be operated in a pulsed mode, and that electrical power may be supplied in a continuous manner, where the voltage may be adjusted based on the command signal received from controller 360.

In pulsed operation, the duty cycle may be adjusted between 0% and 100%, or between 0 and 1. During pulsed operation, electrical power (e.g., voltage) may be pulsed OFF (e.g., zero voltage) or ON (e.g., non-zero voltage). The duty cycle may refer to the proportion of the time that the pulse is ON and a non-zero voltage is supplied. As such, one or more of the pumps 366 and 368 may be OFF when their respective duty cycles are 0.

In one example, during pulsed operation, the pulsed ON voltage may be adjusted to more closely flow fuel at a desired flow rate. Thus, the magnitude of the pulsed voltages may be adjusted. For example, when fuel levels in a fuel tank (e.g., fuel tank 202 described above in FIG. 2) decrease below a threshold, one or more of pumps 366 and/or 368 may be operated ON at a lower voltage to decrease the likelihood of lift pump burnout.

In some examples, the first fuel lift pump 366 may be operated in continuous operation and the second fuel lift pump 368 may be operated in pulsed operation. However, in other examples, the second fuel lift pump 368 may be operated in continuous operation and the first fuel lift pump 366 may be operated in pulsed operation. In yet further examples, both the fuel pumps 366 and 368 may be operated in a continuous operation. In yet further examples, both the fuel pumps 366 and 368 may be operated in pulsed operation.

Further, the second fuel lift pump 368 may be turned ON when the FPC signal 365 exceeds a threshold voltage and/or duty cycle, and may be turned OFF when the FPC signal 365 decreases below the threshold voltage and/or duty cycle. For example, the second fuel lift pump 368 may be turned ON in response to one or more of a driver tip-in, the desired fuel pressure increasing above a threshold, the difference between the desired fuel pressure and measured fuel pressure increasing by more than a threshold difference, and the desired fuel flow rate increasing above a threshold, etc. The pump electronics modules 362 and 364 may determine the duty cycle for each motor 372 and 374 by using a duty cycle look-up table, such as the duty cycle maps shown in FIG. 5, mapping the FPC signal 365 to the fuel pump duty cycles.

In some examples, the modules 362 and 364 may respond differently to the same FPC signal 365 received from the controller 360. Thus the modules 362 and 364 may include different computer-readable instructions stored in non-transitory memory for regulating fuel pump operation based on signals received from the controller 360. Thus, the modules 362 and 364 may include different look-up tables for mapping the FPC signal 365 to the duty cycles for the respective pumps 366 and 368. In this way, the two lift pumps 366 and 268 may be operated differently by the modules 362 and 364 given the same command signal from the controller 360. Thereby, two fuel lift pumps may be operated differently using a single command pin on controller 360.

Figure 4:
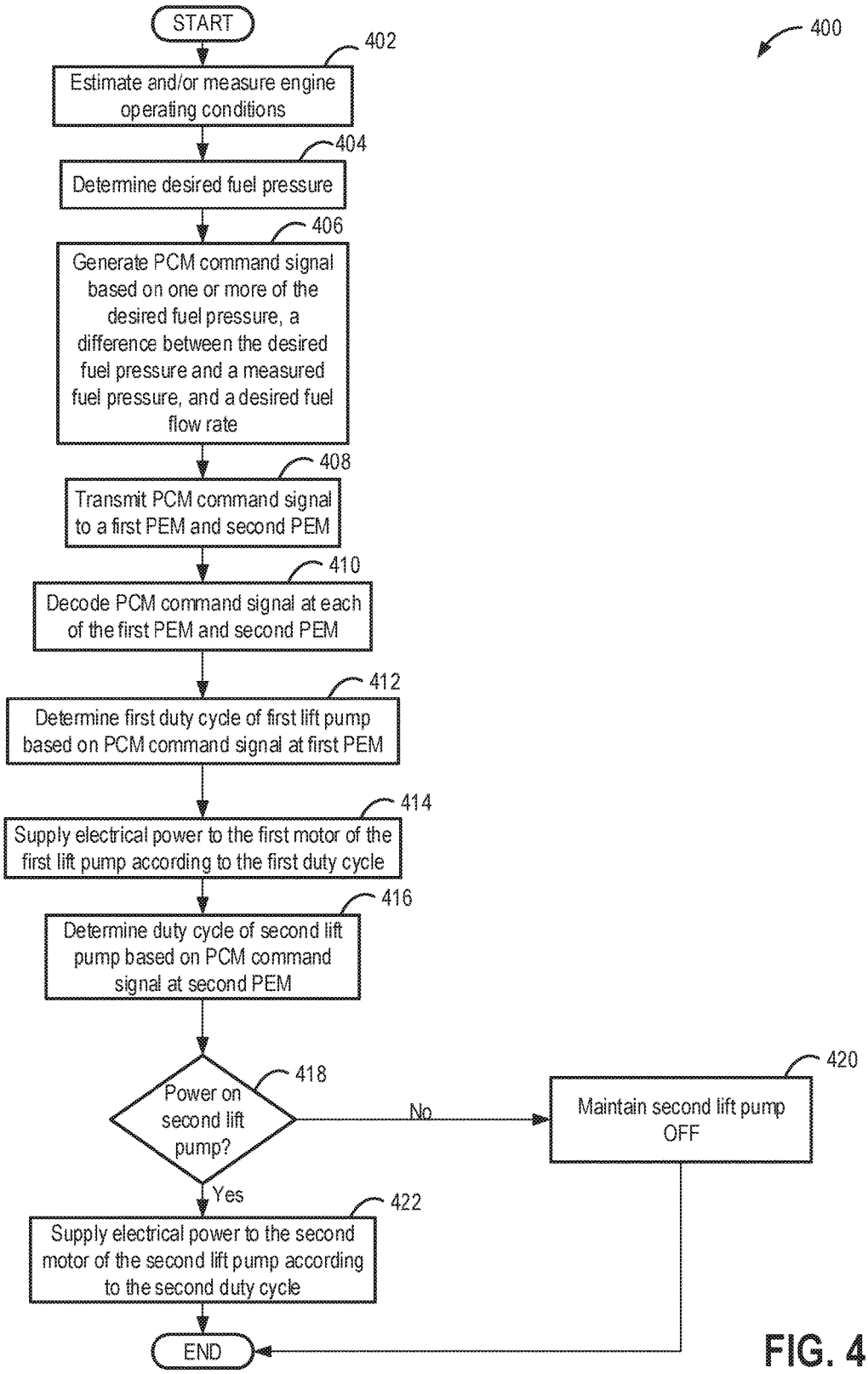
FIG. 4 shows a flow chart of an example method for regulating operation of a fuel system including two lift pumps, such as the fuel system of FIG. 1, in accordance with an embodiment of the present disclosure.

Turning now to FIG. 4, it illustrates an example method 400 for operating two fuel lift pumps of a fuel system (e.g., fuel system 8 described above in FIGS. 1-2). In particular electrical power supplied to a first motor (e.g., motor 372 described above in FIG. 3) of a first lift pump (e.g., lift pump 208 described in FIG. 2) and a second motor (e.g., second motor 374 described above in FIG. 3) of a second lift pump (e.g., lift pump 218 described above in FIG. 2) may be regulated by a controller (e.g., controller 360 described above in FIG. 3) via respective pump electronic modules (e.g., PEMs 362 and 364 described above in FIG. 3). The controller may feedback control operation of the pumps based on a difference between a desired fuel rail pressure of one or more fuel rails (e.g., fuel rails 240 and 250 described above in FIG. 2) and a measured fuel rail pressure.

Thus, the command signal generated by the controller and sent to the PEMs to control an additional amount of electrical power supplied to the lift pumps may be proportional to the difference between the desired fuel rail pressure and the measure fuel rail pressure. For example, the command signal and an electrical power supplied to the first lift pump may be proportional to a difference between the desired fuel rail pressure and the measured fuel rail pressure, when the measured fuel rail pressure is less than desired. More specifically, the command signal and electrical power supplied to the first lift pump may monotonically increase for increases in the difference between the desired fuel rail pressure and the measured fuel rail pressure, when the measured fuel rail pressure is less than desired. Thus, the electrical power supplied to the first lift pump may be proportional to the command signal sent from the controller. However, the second pump may not receive electrical power when the command signal is less than a threshold (e.g., the measured fuel rail pressure is not lower than the desired fuel rail pressure by more than a threshold). The second pump may be powered on when the command signal is greater than the threshold (e.g., the difference between the fuel rail pressure and desired fuel rail pressure is greater than a threshold pressure difference, and the measured fuel rail pressure is less than the desired fuel rail pressure).

Method 400 begins at 402 which comprises estimating and/or measuring engine operating conditions. Engine operating conditions may include one or more of driver demanded torque, engine load, fuel rail pressure, fuel level, engine speed, fuel injection amount, intake mass airflow, etc. The engine operating conditions may be estimated based on inputs received from various sensors. For example fuel rail pressure may be estimated based on outputs from one or more fuel rail pressure sensors (e.g., sensors 238 and 248 described above in FIG. 2). Fuel level in a fuel tank may be estimated based on outputs from a fuel level sensor (e.g., sensor 210 described above in FIG. 2).

Method 400 may then continue from 402 to 404 which comprises determining a desired fuel pressure, which may be a desired pressure of port fuel injection fuel rail (e.g., fuel rail 240 described above in FIG. 2) and/or a desired pressure of the direct injection fuel rail (e.g., fuel rail 250 described above in FIG. 2), based on one or more of an intake manifold pressure, fuel injection rate, fuel volatility, engine speed, and fuel temperature. However, the desired fuel rail pressure may additionally or alternatively be based on additional engine operating conditions such as a position of an engine throttle (e.g., throttle 162 shown in FIG. 1), engine load, alternator torque, exhaust pressure, speed of a turbocharger (e.g., compressor 174 shown in FIG. 1), intake temperature, intake pressure, etc.

The method 400 at 404 may additionally or alternatively comprise determining a desired fuel flow rate. In particular a feed-forward scheduler may be used to determine a desired fuel flow rate based on a fuel injection amount. Thus, based on a commanded fuel injection amount and/or on an amount of fuel leaving the one or more fuel rails via fuel injectors (e.g., injectors 242 and 252 described above in FIG. 2), a desired fuel flow rate may be determined. The desired fuel flow rate may be approximately a flow rate of fuel sufficient to replace the fuel leaving the fuel rail via the fuel injectors, at least in one example.

Method 400 may continue from 404 to 406 which may comprise generating a PCM command signal (e.g., FPC signal 365 described above in FIG. 3) based on one or more of the desired fuel pressure, a difference between the desired fuel pressure and a measured fuel pressure, and the desired fuel flow rate. Thus, the PCM command signal may be generated based on a feedback term (e.g., based on a difference between desired and measured fuel rail pressures), and a feedforward term. The PCM command signal may correspond to a duty cycle or voltage signal to be supplied to one or more lift pumps (e.g., lift pumps 208 and 218 described above in FIG. 2). In this way, a commanded lift pump duty cycle may increase for increases in one or more of the desired fuel pressure, desired fuel flow rate, fuel injection flow rate, and/or difference between the desired fuel pressure and measured fuel pressure when the measured fuel pressure is less than desired. Thus, in examples where a common PCM command signal is generated and sent to both PEMs, the PCM command signal may be generated based on one or more of a fuel pressure feedback control term, fuel injection feedforward control term, and in some examples, an adaptive term.

The PCM command signal may additionally be generated based on a position of an accelerator pedal (e.g., input device 132 described above in FIG. 1). For example, during a tip-in such as when an operator (e.g., operator 130 described above in FIG. 1) depresses the accelerator pedal by more than a threshold angle, the driver demanded torque and thus, fuel injection rate may increase. As such, the desired fuel flow rate and/or desired fuel pressure may increase. Thus, in some examples, the method 400 at 414 may comprise determining if a driver demanded torque increase is greater than a threshold and/or a tip-in event is occurring.

The PCM command signal may be an electrical signal that may be sent from the controller to the one or more PEMs. In particular the PCM command signal may be a voltage and/or current. In some examples, the PCM command signal may be a time-varying signal. In particular the PCM command signal may be a pulsed voltage signal. Thus, the PCM command signal may include a duty cycle. The PCM command signal may be generated by a summer based on signals received from the pressure scheduler, feed-forward scheduler, integrator, etc.

Method 400 may then continue from 406 to 408 which comprises transmitting the PCM command signal to a first PEM (e.g., first PEM 362 described above in FIG. 3) and a second PEM (e.g., second PEM 364 described above in FIG. 3). In some examples, the transmitting may comprise sending an electrical signal via a wire. As discussed above with reference to FIG. 3, the command signal may be a pulsed or timed signal to be interpreted as a percent command. In some examples, the method 400 at 408 may comprise sending the same signal to the first PEM and the second PEM. However, in other examples, different command signals (e.g., voltages and/or duty cycles) may be sent to the PEMs. Thus, at 412, the controller may send the PCM command signal to one or more of the PEMs.

In examples where different PCM command signals are sent to each of the PEMs, method 400 at 404 may additionally comprise determining whether the desired fuel pressure and/or desired fuel flow rate can be supplied by a first lift pump (e.g., lift pump 208 described above in FIG. 2). If the desired fuel pressure and/or desired fuel flow rate can be delivered by the first lift pump, then a desired voltage to be supplied to the first lift pump may be determined based on one or more of the desired fuel pressure and desired fuel flow rate. Further, the PCM command signal may be determined based on the desired fuel pressure and a measured system voltage. Thus when only the first lift pump is needed to achieve the desired fuel pressure and/or fuel flow rate, a first PCM command signal may be sent to the first lift pump, corresponding to an amount of electrical power to be supplied to the first lift pump. Further a second PCM command signal may be sent to the second PEM corresponding to a 0% duty cycle to be supplied to a second lift pump (e.g., lift pump 218 described above in FIG. 2). If both of the pumps are needed to supply the desired fuel pressure and/or fuel flow rate, then a first PCM command signal corresponding to an approximately 100% duty cycle for the first lift pump may be sent to the first PEM. A second PCM command signal may be determined and sent to the second PCM corresponding to a duty cycle to be supplied to the second lift pump. The second PCM command signal may be determined based the desired fuel pressure and/or desired fuel flow rate.

Method 400 then continues from 408 to 410 which comprises decoding the PCM command signal at each of the first PEM and second PEM. Thus, the method 400 at 410 may comprise receiving the PCM command signal at teach of the first PEM and second PEM.

Method 400 may then continue from 410 to 412 which comprises determining a first duty cycle of the first lift pump based on the PCM command signal at the first PEM. Thus, based on the received PCM command signal, the first PEM may determine the first duty cycle of the first lift pump. In particular, the first PEM may include computer-readable instructions for converting the PCM command signal into a duty cycled voltage to be supplied to the first lift pump. Example duty cycles of the first lift pump are shown in greater detail below with reference to FIG. 5. The first duty cycle of the first lift pump may in some examples be proportional to the PCM command signal. Thus, the first duty cycle of the first lift pump may increase for increases in one or more of the desired fuel pressure, difference between the desired fuel pressure and measured fuel pressure, and desired fuel flow rate.

Method 400 may then continue from 412 to 414 which comprises supplying electrical power to the first motor of the first lift pump in accordance with the duty cycle determined at 412. Thus, the first PCM may supply electrical power to a first motor (e.g., motor 372 described above in FIG. 3) of the first lift pump. The electrical power supplied to the first motor may be regulated by the first PEM.

Method 400 may then continue from 414 to 416 which comprises determining a second duty cycle of the second lift pump based on the PCM command signal at the second PEM. Thus, based on the received PCM command signal, the second PEM may determine the second duty cycle of the second lift pump. In particular, the second PEM may include computer-readable instructions for converting the PCM command signal into a duty cycled voltage to be supplied to the second lift pump. However, the second PEM may convert the PCM command signal in a different duty cycled voltage than the first PEM. Example duty cycles of the second lift pump are shown in greater detail below with reference to FIG. 5.

Method 400 may then continue from 416 to 418 which comprises determining if it is desired to power on the second lift pump. The determining whether it is desired to turn on the second lift pump may be based on the PCM command signal received at the second PEM. Thus, the second PEM may convert the PCM command signal into a duty cycled voltage to be supplied to the second lift pump based on computer readable instructions stored in non-transitory memory of the second PEM. It may be desired to power on the second lift pump when the duty cycle of the PCM command signal is greater than a threshold, where the threshold may represent a duty cycle of the PCM command signal at which the first duty cycle of the first lift pump is substantially 100%. Thus, it may be desired to power on the second lift pump when the first duty cycle of the first lift pump is at or greater than a first threshold and still additional fuel pressure is desired. In some examples, the first threshold may be approximately 100%. Thus, the second lift pump may be powered on when the first lift pump is operated at maximum electrical power, but is not sufficient to deliver the desired fuel pressure and/or fuel flow rate. However, in other examples, the first threshold duty cycle of the first lift pump, below which the second pump may remain off, may be less than 100%. Thus, the second duty cycle of the second lift pump may be substantially 0% when the duty cycle of the first lift pump is less than a first threshold.

For example, the PCM command signal may be greater than the threshold when a driver demanded torque increases above a threshold. Thus, the determining if it is desired to power on the lift pump at 418 may comprise determining if a driver demanded torque increase is greater than a threshold. For example, during a tip-in such as when an operator (e.g., operator 130 described above in FIG. 1) depresses an accelerator pedal (e.g., input device 132 described above in FIG. 1) by more than a threshold angle, the driver demanded torque may increase by more than the threshold. Thus, it may be desired to power on the second lift pump in response to a tip-in and/or when a driver demanded torque increases above a threshold.

Additionally or alternatively, the PCM command signal may be greater than the threshold when a desired fuel injection amount increases above a threshold. For example, when the driver demanded torque increases, the desired fuel injection may increase to deliver the desired torque. When the desired fuel injection amount increases by more than the threshold, the first lift pump may not be sufficient to deliver a desired fuel flow rate to the fuel rail to maintain fuel rail pressure and/or replace the fuel volume and/or mass lost to fuel injection. Thus, the determining if it is desired to power on the lift pump may comprise determining if the fuel injection rate is greater than a threshold and/or the desired fuel flow rate to the one or more fuel rails is greater than a threshold. If the fuel injection rate increases above a threshold, and/or the desired fuel flow rate (volume or mass flow rate) to the fuel rail from the lift pumps increases above a threshold, then method 400 may continue from 418 to 422, and the second lift pump may be powered on to achieve the desired fuel flow rate to the fuel rails.

Additionally or alternatively, the PCM command signal may be greater than the threshold when the desired fuel rail pressure increases above a threshold. Thus, the determining if it is desired to power on the lift pump may comprise determining if the desired fuel pressure is greater than a threshold. Thus, in some examples, the lift pump may be powered on when the desired fuel rail pressure increases above a threshold.

Additionally or alternatively, the PCM command signal may be greater than the threshold when the difference between the desired fuel rail pressure and the measured fuel pressure is greater than the threshold difference. Thus, the determining if it is desired to power on the lift pump may comprise determining if the difference between the desired fuel rail pressure and the measured fuel rail pressure is greater than a threshold. Thus, in some examples, it may be desired to power on the second lift pump when the difference between the desired fuel rail pressure and the measured fuel rail pressure is greater than a threshold difference.

In yet further examples, the method 400 at 418 may comprise predicting future changes in fuel rail pressure based on current fuel flow rates from one or more of the lift pumps, fuel injection rates, and predicted future driver demanded torque requests. For example, during a tip-in, the fuel injection rate may increase, and the fuel rail pressure may drop in the future due the increased fuel injection rate. Thus, based on fuel predicted fuel injection rate, which may be predicted based on one or more of future driver demanded torque request, future engine loads, future accessory loads, future boost pressure profiles, etc., future fuel rail pressure profiles may be generated based on current lift pump operation. In some examples, if it is predicted in the future that the fuel rail pressure will drop below the desired fuel rail pressure by more than the threshold, then method 400 may continue from 418 to 422 and may power on the second lift pump such that the fuel rail pressure does not decrease below the desired fuel rail pressure by more than the threshold. In this way, the second lift pump may be powered on to reduce and/or prevent drops in fuel rail pressure.

If it is determined at 418 that it is not desired to power on the second lift pump, then method 400 may continue from 418 to 420 which comprises maintaining the second lift pump off. Method 400 then returns.

However, if it is determined at 418 that it is desired to power on the second lift pump, then method 400 may continue to 422 which comprises supplying electrical power to a second motor (e.g., motor 374 described above in FIG. 3) of the second lift pump according to the second duty cycle. The second duty cycle of the second lift pump may step up from 0% to a second threshold duty cycle such as 50%, when the first duty cycle of the first lift pump meets and/or exceeds the first threshold duty cycle. However, in other examples, the second threshold duty cycle of the second lift pump may be greater than or less than 50%. In some examples, the second threshold duty cycle of the second lift pump may be 100%. That is, the second lift pump may either be operated at a 0% duty cycle or a 100% duty cycle. The electrical power supplied to the second motor may be regulated by the second PEM. Method 400 then ends.

Moving on to FIG. 5 it shows example plots mapping lift pump duty cycle to PCM command signals for a fuel system (e.g., fuel system 8 described above in FIGS. 1-2) including a smaller first lift pump (e.g., lift pump 366 described above in FIG. 3) and a larger second lift pump (e.g., lift pump 368 described above in FIG. 3). In particular, FIG. 5, shows a first plot 500 and second plot 525 depicting a first example control scheme for regulating the duty cycles of the first lift pump and second pump lift pump, respectively, in response to changes of the PCM command signal. Further, third plot 550 and fourth plot 575 depicting a second example control scheme for regulating the duty cycles of the first lift pump and second pump lift pump, respectively, in response to changes of the PCM command signal.

In plots 500, 525, 550, and 575, the duty cycle is shown along the vertical axis, and the PCM command signal is shown along the horizontal axis. As described above with reference to FIGS. 3-4, the PCM command signal may correspond to a signal sent from a controller (e.g., controller 360 described above in FIG. 3) to respective PEMs (e.g., PEMs 362 and 364 described above in FIG. 3) of the lift pumps. The duty cycle may represent the duty cycle for the lift pumps. Thus, a duty cycle of 1 may correspond to a 100% duty cycled voltage signal. A duty cycle of 0 may correspond to no electrical power supply (e.g., 0% duty cycled voltage signal). Thus, the duty cycle may be on a scale from 0, indicating a low idling operation or OFF state, to 1, indicating maximum power supply to the indicated lift pump.

Plots 500 and/or 550 may be stored as a look-up table in non-transitory memory of a first PEM (e.g., first PEM 362 described above in FIG. 3) that regulates the duty cycle of the first lift pump. Thus, the first PEM may use a look-up table such as one of plots 500 or 550 for converting the PCM command signal received from the controller into a duty cycle for the first lift pump.

Similarly, plots 525 and 575 may be stored as a look-up table in non-transitory memory of a second PEM (e.g., second PEM 364 described above in FIG. 3) that regulates the duty cycle of the second lift pump. Thus, the second PEM may use a look-up table such as one of plots 525 or 575 for converting the PCM command signal received from the controller into a duty cycle for the second lift pump.

In the first control scheme, as shown in plots 500 and 525, the duty cycle of the first lift pump may be directly proportional to the commanded PCM signal. Then, once the duty cycle of the first lift pump reaches a threshold (e.g., 100% duty cycle) and/or the PCM command signal reaches a threshold (e.g., 99% duty cycle) the second lift pump may be powered on to a maximum duty cycled voltage. As shown in the example of plot 500, the first lift pump may be operated continuously, indicated by the linear relationship between the PCM command signal and the duty cycle of first lift pump. As the duty cycle of the PCM command increases, the duty cycle of the first lift pump may increase proportionally. Turning now to the second example plot 525, the second lift pump may be powered OFF and may not be supplied with electrical power, when the PCM command signal is less a threshold. In the example of FIG. 4, the threshold may be 99% PCM command. However, in other examples, the threshold may be less than 99%. Thus, the second lift pump may be turned on at an upper limit of PCM command voltage signal, but below the upper limit may be powered off.

In the second control scheme, as shown in plots 550 and 575, the duty cycle of the first lift pump may reach 100% when the PCM command signal reaches a threshold (e.g., 50% duty cycled PCM signal as depicted in plot 550). Further, the duty cycle of the second lift pump may be stepped up from 0% to a threshold (e.g., 50% duty cycle as depicted in plot 575) when the duty cycle of the first lift pump reaches 100% and/or the PCM command signal reaches the threshold. The duty cycle of the second lift pump may then increase proportionally for continued increases in the duty cycle of the PCM command signal above the threshold.

Thus, the second lift pump may remain off when the duty cycle of the first lift pump is less than the threshold (e.g., 100% duty cycle). The first PEM may convert the PCM command signal into a 100% duty cycle when the duty cycle of the PCM command signal is greater than the first threshold. Further, the second PEM may convert the PCM command signal into a 0% duty cycle when the duty cycle of the PCM command signal is less than the first threshold. When the PCM command signal reaches the first threshold, the PEM may step up the duty cycle of the second lift pump from 0% to a second threshold duty cycle in response to the PCM command signal reaching the first threshold. In this way, the second lift pump may be powered on for PCM command signals above the first threshold, where the first lift pump is operated at maximum power.

Figure 6:
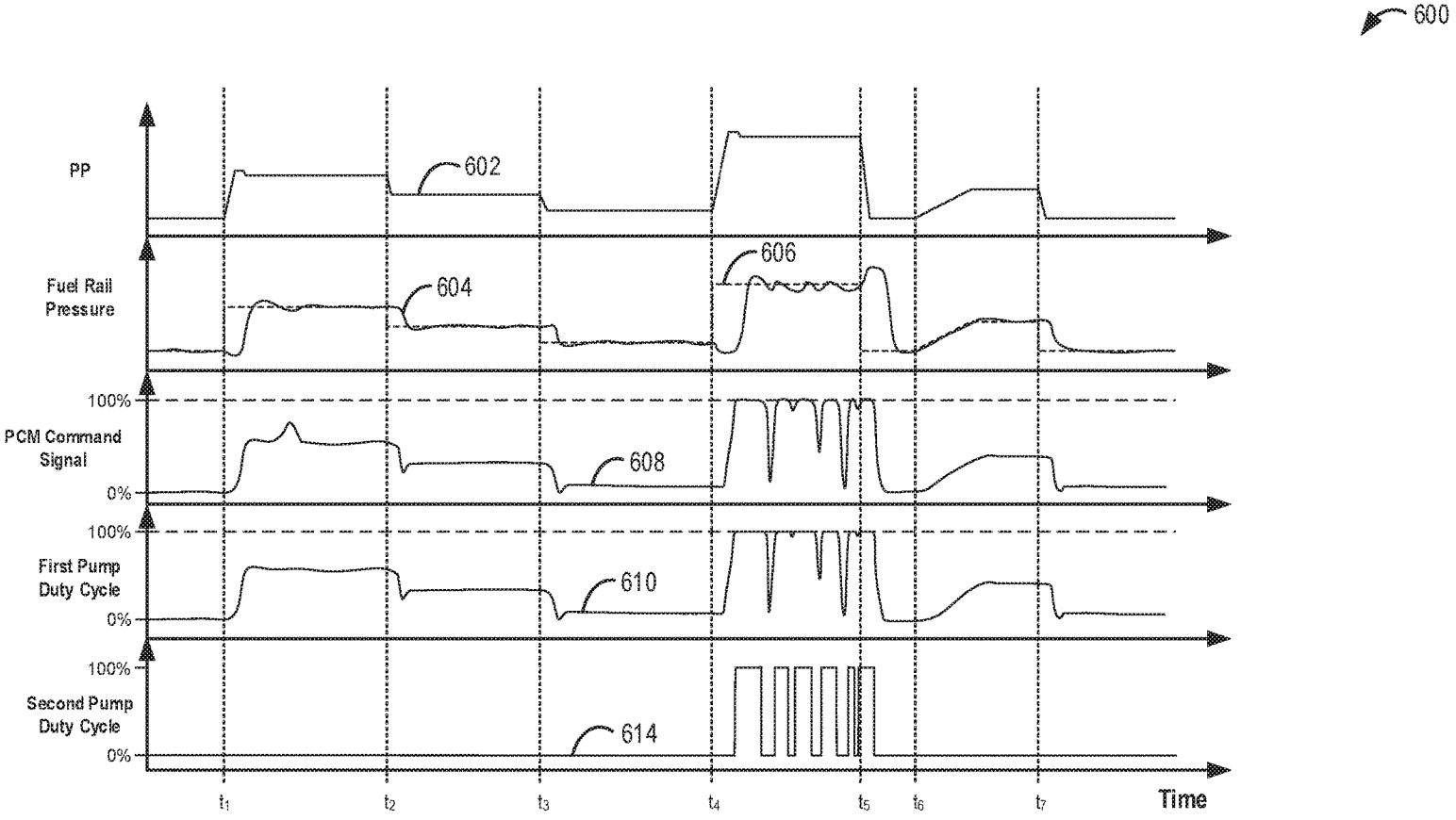
FIG. 6 shows a graph depicting example changes in lift pump operation under varying engine operating conditions, in accordance with an embodiment of the present disclosure.

Continuing to FIG. 6, it shows an example graph 600 illustrating example operation of two lift pumps (e.g., lift pumps 366 and 368 described above in FIG. 3) under varying engine operating conditions. The horizontal axis (x-axis) denotes time. The first plot 602 shows variation in pedal position and thus driver demanded torque over time. The second plot 604 shows variation of a measured fuel rail pressure over time. The fuel rail pressure may be measured via one or more fuel rail pressure sensor (e.g., fuel rail pressure sensors 238 and 248 described above in FIG. 2). The third plot 606 shows changes in a desired fuel rail pressure as determined based on the driver demanded torque and/or engine operating conditions. Plot 608 depicts changes in a PCM command signal (e.g., direct current) command signal over time, plot 610 depicts changes in voltage supplied to a first lift pump (e.g., lift pump 366 described above in FIG. 3) as a percent of the maximum pump voltage of the first lift pump, and plot 614 depicts changes in the voltage supplied to a second lift pump (e.g., second lift pump 368 described above in FIG. 3) as a percent of the maximum pump voltage of the second lift pump.

Prior to time $t_1$, the engine is operating at substantially constant speed. At time $t_1$, the operator tips in from closed pedal signaling an increase in driver demanded torque. As fuel is injected into the engine to increase engine torque, the fuel rail pressure decreases and thus the desired fuel rail pressure correspondingly increases, as indicated at plot 606, to account for the increased fuel consumption rate and decreased fuel rail pressure. As the measured fuel rail pressure decreases below the desired fuel rail pressure, a controller (e.g., controller 360 described above in FIG. 3) may send a command signal to one or more of the PEMs, indicating an increase in the desired fuel flow rate. The pump electronics modules then determine pump duty cycles for the lift pump, as described in FIG. 3. The first lift pump duty cycle may be approximately linear with respect to the PCM command signal. At time $t_1$, the second pump is maintained disabled as the PCM command signal remains below a threshold. In some examples the threshold may be 100%. However, in other examples the threshold may be less than 100%.

At time $t_2$, the operator tips out, signaling a decrease in the driver demanded torque. The desired fuel rail pressure thus correspondingly decreases. Due to the decrease in fuel injection rate, the PCM command signal likewise decreases. As before time $t_1$ the second pump is maintained OFF while the first pump maintains the desired fuel pressure. At time $t_3$, the operator tips out indicating a decrease in the driver demanded torque. The desired rail pressure decreases and PCM command signal and corresponding duty cycle of the first lift pump are reduced. The second pump remains OFF. At time $t_4$, the operator tips in to operate the engine at a higher engine load condition, resulting in an increase in the desired fuel injection rate. An increase in fuel rail pressure is thus desired, as the fuel rail pressure of the fuel rail decreases due to exit of fuel from the fuel rail via the increased fuel injection. Due to the decrease in fuel rail pressure, the PCM command signal is set to 100% command, and as such both the first and second fuel pumps are enabled and operated at their maximum voltages and/or duty cycles. Between $t_4$ and $t_5$, the second lift pump is pulse operated until the first lift pump may provide the desired fuel rail pressure without the added pressure provided by the second fuel pump.

At time $t_5$, the operator tips out to an engine idling condition, decreasing the fuel injection rate. The desired fuel rail pressure is likewise decreased in response to the operator tip out. The fuel rail pressure may continue to increase due to operation of the first lift pump as fuel injection rates decreases. However, both lift pumps may be powered OFF, when the measured fuel rail pressure exceeds the desired fuel rail pressure. At time $t_6$, the operator tips in, gradually increasing the pedal position. As the pedal position is increased, the demanded torque increases, and fuel injection increases. The duty cycle of the first lift pump is increased to supply the desired fuel rail pressure. The second pump may remain off. At time $t_7$, the operator tips out to an engine idling condition. Likewise, the desired fuel injection amount decreases. The duty cycle of the first lift pump may continue to be adjusted, to maintain the fuel rail pressure substantially equal to the desired fuel rail pressure. While the engine is in an idling condition, the second lift pump may remain disabled.

In this way, a technical effect of more accurately maintaining a fuel rail pressure to a desired fuel rail pressure is achieved by operating two lift pumps differently based on common input command from an engine controller. Further, a technical effect of reducing fuel consumption is achieved by operating a smaller lift pump when the difference between a desired fuel rail pressure and a measured fuel rail pressure is less than a threshold. Thus, by only operating both a first lift pump and second lift pump when the difference between the desired fuel rail pressure and the measured fuel rail pressure is greater than a threshold difference, energy consumption may be reduced, and the longevity of a lift pump may be increased. Further, an amount of electrical wiring and processing hardware may be reduced by differentially operating two lift pump given the same input command from an engine controller.

In one representation, a method may comprise, adjusting operation of a first lift pump based on a difference between a desired fuel rail pressure and a measured fuel rail pressure, and in response to one or more of an accelerator pedal tip-in, desired fuel rail pressure increasing above a threshold pressure, and the difference between the desired fuel rail pressure and the measured fuel rail pressure increasing by more than a threshold difference, powering on a second lift pump. In any one or more combinations of the above methods, the adjusting operation of the first lift pump may comprise adjusting an amount of electrical power supplied to a motor of the first lift pump. In any one or more combinations of the above methods, the adjusting the amount of electrical power supplied to the motor of the first lift pump may monotonically increase for increases in the difference between the desired fuel rail pressure and the measured fuel rail pressure when the measured fuel rail pressure is less than the desired fuel rail pressure. In any one or more combinations of the above methods, the adjusting operation of the first lift pump may comprise adjusting a duty cycle of the first lift pump. Any one or more combinations of the above methods may further comprise, powering off the first lift pump in response to the measured fuel rail pressure increasing above the desired fuel rail pressure. Any one or more combinations of the above methods, may further comprise powering off the second lift pump and only continuing to supply power to the first lift pump in response to the difference between the desired fuel rail pressure and the measured fuel rail pressure decreasing below the threshold difference. In any one or more combinations of the above methods, the powering on the second lift pump may comprise stepping up the electrical power supplied to the second lift pump to a maximum electrical power. In any one or more combinations of the above methods, the first lift pump may be smaller than the second lift pump, and where a first maximum electrical power of the first lift pump may be less than a second maximum electrical power of the second lift pump. In any one or more combinations of the above methods, the desired fuel rail pressure may be determined based on one or more of a driver demanded torque, engine load, accessory load, mass airflow rate, fuel injection mass flow rate, and boost pressure.

In another representation, a method may comprise generating a fuel pump command based on one or more of a desired fuel pressure, a difference between the desired fuel pressure and a measured fuel pressure, and a fuel injection amount, determining a first duty cycle for a first lift pump based on the fuel pump command, determining a second duty cycle for a second lift pump based on the fuel pump command, and adjusting operation of the first and second lift pumps based on the first and second duty cycles, respectively. In any one or more combinations of the above methods the measured fuel rail pressure may be determined based on outputs from one or more fuel rail pressure sensors positioned within a fuel rail. In any one or more combinations of the above methods the first duty cycle may be different than the second duty cycle. In any one or more combinations of the above methods the desired fuel pressure may be determined based on one or more of a driver demanded torque, engine speed, intake mass airflow, fuel volatility, and fuel temperature. In any one or more combinations of the above methods, the second duty cycle may be substantially zero percent, such that no electrical power is provided to the second lift pump when the fuel pump command is less than a first threshold, and where the second duty cycle may be stepped up from 0% to a second threshold, when the fuel pump command is greater than the first threshold. In any one or more combinations of the above methods the first duty cycle may be proportional to the fuel pump command. In any one or more combinations of the above methods the first duty cycle may be substantially zero percent, such that no electrical power is provided to the first lift pump when the difference between the measured fuel rail pressure and the desired fuel rail pressure is less than a threshold.

In another representation, a method may comprise: estimating a desired increase in fuel rail pressure based on a difference between a measured fuel rail pressure and a desired fuel rail pressure, determining a first duty cycle for a first lift pump based on the desired increase in fuel rail pressure, determining a second duty cycle for a second lift pump based on the desired increase in fuel rail pressure, and adjusting operation of the first and second lift pumps based on the first and second duty cycles, respectively. In any one or more combinations of the above methods, the measured fuel rail pressure may be determined based on outputs from one or more fuel rail pressure sensors positioned within a fuel rail. In any one or more combinations of the above methods, the first duty cycle may be different than the second duty cycle when the difference between the measured fuel rail pressure and the desired fuel rail pressure is less than a threshold. In any one or more combinations of the above methods, the first duty cycle may be substantially the same as the second duty cycle when the difference between the measured fuel rail pressure and the desired fuel rail pressure is greater than a threshold. In any one or more combinations of the above methods, the second duty cycle may be substantially zero percent, such that no electrical power is provided to the second lift pump when the difference between the measured fuel rail pressure and the desired fuel rail pressure is less than a threshold, and where the second duty cycle is substantially 100 percent, where maximum electrical power is provided to the second lift pump when the difference between the measured fuel rail pressure and the desired fuel rail pressure is greater than the threshold. In any one or more combinations of the above methods, the first duty cycle may be proportional to the difference between the measured fuel rail pressure and the desired fuel rail pressure when the measured fuel rail pressure is less than the desired fuel rail pressure. In any one or more combinations of the above methods, the first duty cycle may be substantially zero percent, such that no electrical power is provided to the first lift pump when the difference between the measured fuel rail pressure and the desired fuel rail pressure is less than a threshold.

In another representation, a fuel system may comprise: a first lift pump, a second lift pump, a first lift pump module for regulating a first duty cycle of the first lift pump, a second lift pump module for regulating a second duty cycle of the second lift pump, and a controller in electrical communication with the first and second pump modules, where the controller may include computer-readable instruction stored in non-transitory memory for: generating a lift pump command signal based on a difference between a desired fuel rail pressure and a measured fuel rail pressure, and transmitting the lift pump command signal to the first lift pump module and second lift pump module. In any one or more combinations of the above system, the controller may be electrically coupled to the first and second lift pump modules via a single wire and pin. In any one or more combinations of the above systems, the first lift pump module may include computer-readable instructions stored in non-transitory memory for adjusting the first duty cycle of the first lift pump based on the lift pump command signal received from the controller, and where the instructions may comprise: reducing the first duty cycle to zero percent and powering off the first lift pump in response to the measured fuel rail pressure increasing above the desired fuel rail pressure, and increasing the first duty cycle between 0% and 100% in proportion to an amount of increase between the measured fuel rail pressure and the desired fuel rail pressure when the measured fuel rail pressure is less than the desired fuel rail pressure. In any one or more combinations of the above systems, the second lift pump module may include computer-readable instructions stored in non-transitory memory for adjusting the second duty cycle of the second lift pump based on the lift pump command signal received from the controller, and where the instructions may comprise: reducing the first duty cycle to zero percent and powering off the second lift pump in response to a difference between the measured fuel rail pressure desired fuel rail pressure decreasing below a threshold when the measured fuel rail pressure is less than the desired fuel rail pressure, and stepping up the first duty cycle from 0% and 100% only when the measured fuel rail pressure is less than the desired fuel rail pressure by more than a threshold.

In still another representation, a method of multi-fuel lift pump operation may include operating the first pump over a majority of its operating range while the other pump is deactivated, and then only for the highest flow rate, operating both pumps, where the second pump is either fully activated or fully deactivated without any other amount of operation therebetween other than transitioning therebetween.

It will be appreciated that the configurations and routines disclosed herein are exemplary in nature, and that these specific embodiments are not to be considered in a limiting sense, because numerous variations are possible. For example, the above technology can be applied to V-6, 1-4, 1-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method comprising:

adjusting operation of a first lift pump, including a duty cycle of the first lift pump, based on a difference between a desired fuel rail pressure and a measured fuel rail pressure, the desired fuel rail pressure determined based on one or more of a driver demanded torque, engine load, accessory load, mass airflow rate, fuel injection mass flow rate, and boost pressure; and in response to one or more of an accelerator pedal tip-in, the desired fuel rail pressure increasing above a threshold pressure, and the difference increasing by more than a threshold difference, powering on a second lift pump.

2. The method of claim 1, wherein the adjusting operation of the first lift pump further comprises adjusting an amount of electrical power supplied to a motor of the first lift pump.

3. The method of claim 2, wherein the adjusting the amount of electrical power supplied to the motor of the first lift pump monotonically increases the difference between the desired fuel rail pressure and the measured fuel rail pressure when the measured fuel rail pressure is less than the desired fuel rail pressure.

4. The method of claim 1, further comprising powering off the first lift pump in response to the measured fuel rail pressure increasing above the desired fuel rail pressure.

5. The method of claim 1, further comprising powering off the second lift pump and only continuing to supply power to the first lift pump in response to the difference between the desired fuel rail pressure and the measured fuel rail pressure decreasing below the threshold difference.

6. The method of claim 2, wherein the powering on the second lift pump comprises stepping up the amount of electrical power supplied to the second lift pump to a maximum electrical power.

7. The method of claim 1, wherein the first lift pump is smaller than the second lift pump, and where a first maximum electrical power of the first lift pump is less than a second maximum electrical power of the second lift pump.

8. A method comprising:

generating a fuel pump command based on one or more of a desired fuel pressure, a difference between the desired fuel pressure and a measured fuel pressure, and a fuel injection amount;

determining a first duty cycle for a first lift pump based on the fuel pump command;

determining a second duty cycle for a second lift pump based on the fuel pump command; and adjusting operation of the first and second lift pumps based on the first and second duty cycles, respectively.

9. The method of claim 8, wherein the measured fuel pressure is determined based on outputs from one or more fuel rail pressure sensors positioned within a fuel rail.

10. The method of claim 8, wherein the first duty cycle is different than the second duty cycle.

11. The method of claim 8, wherein the desired fuel pressure is determined based on one or more of a driver demanded torque, engine speed, intake mass airflow, fuel volatility, and fuel temperature.

12. The method of claim 8, wherein the second duty cycle is substantially zero percent, such that no electrical power is provided to the second lift pump when the fuel pump command is less than a first threshold, and where the second duty cycle is stepped up from zero percent to a second threshold, when the fuel pump command is greater than the first threshold.

13. The method of claim 8, wherein the first duty cycle is proportional to the fuel pump command.

14. The method of claim 8, wherein the first duty cycle is substantially zero percent, such that no electrical power is provided to the first lift pump when the difference between the measured fuel pressure and the desired fuel pressure is less than a threshold.

15. A fuel system comprising:

a first lift pump;

a second lift pump;

a first lift pump module for regulating a first duty cycle of the first lift pump;

a second lift pump module for regulating a second duty cycle of the second lift pump; and a controller in electrical communication with the first and second lift pump modules, the controller including computer-readable instructions stored in non-transitory memory for:

generating a lift pump command signal based on one or more of a difference between a desired fuel rail pressure and a measured fuel rail pressure, the desired fuel rail pressure, and a fuel injection amount; and transmitting the lift pump command signal to the first lift pump module and the second lift pump module.

16. The fuel system of claim 15, wherein an output of the controller is electrically coupled to the first and second lift pump modules via a single wire and pin.

17. The fuel system of claim 15, wherein the first lift pump module includes computer-readable instructions stored in non-transitory memory for adjusting the first duty cycle of the first lift pump based on the lift pump command signal received from the controller, and where the instructions comprise: reducing the first duty cycle to zero percent and powering off the first lift pump in response to a duty cycle of the lift pump command signal decreasing below a threshold, and increasing the first duty cycle between 0% and 100% in proportion to increases in the duty cycle of the lift pump command signal above the threshold.

18. The fuel system of claim 15, wherein the second lift pump module includes computer-readable instructions stored in non-transitory memory for adjusting the second duty cycle of the second lift pump based on the lift pump command signal received from the controller, and where the instructions comprise: reducing the second duty cycle to zero percent and powering off the second lift pump in response to the first duty cycle of the first lift pump decreasing below a first threshold, and stepping up the second duty cycle from zero percent to a second threshold duty cycle only when the first duty cycle of the first lift pump is greater than the first threshold and the measured fuel rail pressure is less than the desired fuel rail pressure.

* * * * *